US005726139A

United States Patent [19]

Willey et al.

[11] Patent Number: 5,726,139

[45] Date of Patent: Mar. 10, 1998

[54] GLASS CLEANER COMPOSITIONS HAVING GOOD FILMING/STREAKING CHARACTERISTICS CONTAINING AMINE OXIDE POLYMERS FUNCTIONALITY

[75] Inventors: Alan David Willey, Cincinnati; Ronald Anthony Masters, Loveland; Michael Stephen Maile, Maineville, all of Ohio

[73] Assignee: The Procter & Gamble Company, Cincinnati, Ohio

[21] Appl. No.: 615,375

[22] Filed: Mar. 14, 1996

[51] Int. Cl.[6] ..... C11D 1/14

[52] U.S. Cl. ..... 510/181; 510/182; 510/426; 510/433; 510/475; 510/503

[58] Field of Search ..... 510/181, 182, 510/433, 426, 475, 503

[56] References Cited

U.S. PATENT DOCUMENTS

| | | | |
|---|---|---|---|
| 3,882,038 | 5/1975 | Clayton et al. | 252/164 |
| 4,088,598 | 5/1978 | Williams | 252/135 |
| 4,414,128 | 11/1983 | Goffinet | 252/111 |
| 4,548,744 | 10/1985 | Connor | 252/545 |
| 4,606,850 | 8/1986 | Malik | 252/528 |
| 4,659,497 | 4/1987 | Akred et al. | 252/135 |
| 4,683,008 | 7/1987 | Betts | 134/27 |
| 4,690,779 | 9/1987 | Baker et al. | 252/546 |
| 4,769,172 | 9/1988 | Siklosi | 252/153 |
| 4,793,943 | 12/1988 | Haslop et al. | 252/135 |
| 4,797,223 | 1/1989 | Amick et al. | 252/174.23 |
| 4,871,467 | 10/1989 | Akred et al. | 252/135 |
| 4,898,908 | 2/1990 | Lahalih et al. | 524/593 |
| 4,921,627 | 5/1990 | Copeland et al. | 252/99 |
| 4,938,893 | 7/1990 | Copeland et al. | 252/527 |
| 4,971,714 | 11/1990 | Lokkesmoe et al. | 252/95 |
| 5,035,826 | 7/1991 | Durbut et al. | 252/121 |
| 5,059,625 | 10/1991 | Scardera et al. | 514/644 |
| 5,061,396 | 10/1991 | Lovine et al. | 252/174.24 |
| 5,076,954 | 12/1991 | Loth et al. | 252/122 |
| 5,108,643 | 4/1992 | Loth et al. | 252/174.11 |
| 5,167,864 | 12/1992 | Borland et al. | 252/357 |
| 5,238,595 | 8/1993 | Crutcher et al. | 252/174.25 |
| 5,252,245 | 10/1993 | Garabedian, Jr. et al. | 252/153 |
| 5,374,614 | 12/1994 | Behan et al. | 512/3 |
| 5,445,747 | 8/1995 | Kvietok et al. | 252/86 |
| 5,451,341 | 9/1995 | White | 252/547 |
| 5,454,984 | 10/1995 | Graubart et al. | 252/547 |
| 5,458,809 | 10/1995 | Fredj et al. | 252/542 |
| 5,458,810 | 10/1995 | Fredj et al. | 252/542 |
| 5,460,742 | 10/1995 | Cavanagh et al. | 252/144 |
| 5,466,802 | 11/1995 | Panandiker et al. | 544/193.2 |
| 5,468,423 | 11/1995 | Garabedian, Jr. et al. | 252/546 |
| 5,476,615 | 12/1995 | Hall et al. | 252/547 |
| 5,478,489 | 12/1995 | Fredj et al. | 252/99 |
| 5,489,393 | 2/1996 | Connor et al. | 252/134 |
| 5,500,153 | 3/1996 | Figueroa et al. | 252/548 |
| 5,500,154 | 3/1996 | Bacon et al. | 252/551 |
| 5,523,024 | 6/1996 | Garabedian, Jr. et al. | 252/547 |
| 5,531,933 | 7/1996 | Masters et al. | 510/429 |
| 5,536,450 | 7/1996 | Masters et al. | 510/417 |
| 5,536,451 | 7/1996 | Masters et al. | 510/405 |
| 5,585,342 | 12/1996 | Choy et al. | 510/433 |
| 5,597,795 | 1/1997 | Fredj et al. | 510/528 |

FOREIGN PATENT DOCUMENTS

| | | | |
|---|---|---|---|
| WO 92/03528 | 3/1992 | WIPO | C11D 3/14 |
| WO 94/10272 | 5/1994 | WIPO | C11D 1/00 |
| WO 94/25553 | 11/1994 | WIPO | C11D 1/66 |
| WO 95/13354 | 5/1995 | WIPO | C11D 3/42 |

*Primary Examiner*—Douglas J. McGinty
*Assistant Examiner*—John R. Hardee
*Attorney, Agent, or Firm*—Robert B. Aylor

[57] ABSTRACT

Aqueous, liquid hard surface detergent compositions having improved cleaning and good filming/streaking characteristics contain an amine oxide polymer at critical levels. Preferred formulas contain an amount of PVNO effective to provide an improvement in spotting/filming after at least three rewettings of the glass; hydrophobic solvent; detergent surfactant selected from the group consisting of anionic surfactants, amphoteric detergent surfactants including zwitterionic surfactants; and mixtures thereof; and the balance being an aqueous solvent system comprising water and, optionally, non-aqueous polar solvent.

6 Claims, No Drawings

GLASS CLEANER COMPOSITIONS HAVING GOOD FILMING/STREAKING CHARACTERISTICS CONTAINING AMINE OXIDE POLYMERS FUNCTIONALITY

FIELD OF INVENTION

This invention pertains to glass cleaning compositions, preferably liquid detergent compositions for use in cleaning glass, especially window glass, and, preferably, other hard surfaces. Such compositions typically contain detergent surfactants, solvents, builders, etc.

BACKGROUND OF THE INVENTION

The use of, e.g., solvents and organic water-soluble synthetic detergent surfactants at low levels for cleaning glass are known. There are several compositions known that provide good filming/streaking characteristics so that the glass is cleaned without leaving objectionable levels of spots and/or films.

Known detergent compositions comprise certain organic solvents, detergent surfactants, and optional builders and/or abrasives. The prior art, however, fails to teach, or recognize, the advantage of providing an amine oxide polymer material in glass cleaner formulations to provide a residual hydrophilicity.

The preferred liquid cleaning compositions have the great advantage that they can be applied to hard surfaces in neat or concentrated form so that a relatively high level of, e.g., surfactant material and/or organic solvent is delivered directly to the soil. Therefore, liquid cleaning compositions have the potential to provide superior soap scum, grease, and oily soil removal over dilute wash solutions prepared from powdered cleaning compositions. The most preferred compositions are those that provide good cleaning on tough soils and yet clean glass without leaving objectionable levels of spots and/or films.

Liquid cleaning compositions, and especially compositions prepared for cleaning glass, need exceptionally good filming/streaking properties. In addition, they can suffer problems of product form, in particular, inhomogeneity, lack of clarity, or excessive "solvent" odor for consumer use.

SUMMARY OF THE INVENTION

The present invention relates to detergent compositions that can clean glass without leaving objectionable levels of filming and/or streaking and which contain an effective amount of amine oxide polymer which provides the glass, especially window glass, with long lasting higher hydrophilicity. Preferably, said compositions are in the form of an aqueous, liquid, hard surface detergent composition having improved cleaning and good spotting characteristics after rewetting comprising: (A) an amount of water soluble amine oxide polymer effective to provide an improvement in spotting/filming after at least three rewettings of the glass; (B) hydrophobic solvent; (C) detergent surfactant selected from the group consisting of anionic surfactants, amphoteric detergent surfactants including zwitterionic surfactants; and mixtures thereof, and (D) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof and any minor ingredients.

The compositions can be formulated at usage concentrations, or as concentrates, either solid, or liquid, and can be packaged in a container having means for creating a spray to make application to hard surfaces more convenient.

All percentages, parts, and ratios herein are "by weight" and all amounts are approximations, unless otherwise stated.

DETAILED DESCRIPTION OF THE INVENTION

In accordance with the present invention, it has been found that superior detergent compositions for cleaning shiny surfaces such as glass which leave said surface with a desirable appearance, i.e., without objectionable levels of filming and/or streaking, can be further improved to help maintain said desirable appearance for an extended period of time by incorporating an amine oxide polymer which is substantive to said surfaces and which provides a more hydrophilic surface. When such surfaces are rewetted, e.g., as when windows are wetted by rain, the water "sheets" off the surface and the surface is still without objectionable levels of spotting (and/or filming) after the surface dries. As anyone who has cleaned windows can attest, one of the most frustrating things that can happen after windows have been cleaned is for a rain shower to occur and leave spots on the just cleaned window. The present invention meets a long felt need. The preferred aqueous liquid detergent compositions for cleaning shiny surfaces such as glass contain: (A) an amount of amine oxide polymer effective to provide an improvement in spotting/filming after at least three rewettings of the glass; (B) hydrophobic solvent; (C) detergent surfactant selected from the group consisting of anionic surfactants, amphoteric detergent surfactants including zwitterionic surfactants; and mixtures thereof; and (D) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof and any minor ingredients.

A. WATER SOLUBLE AMINE OXIDE POLYMER

An essential part of this invention is the substantive material that improves the hydrophilicity of the surface being treated, especially glass. This increase in hydrophilicity provides improved appearance when the surface is rewetted and then dried. The water "sheets" off the surface and thereby minimizes the formation of, e.g., "rainspots" that form upon drying. The use of polycarboxylate, polystyrene sulfonate, and polyether based polymers to provide this hydrophilicity is known in the art. The use of these polymers is described in P&G Copending application Ser. No. 08/378,205, filed Jan. 25, 1995, Masters, et al., which is herein incorporated by reference. However, the use of relatively low molecular weight, water soluble amine oxide polymers to achieve improved hydrophilicity in a glass cleaner has heretofore not been disclosed in the art.

While as not to be limited by theory, it is believed that the partial positive charge of the amine oxide group acts to adhere the polymer to the surface of the glass. It is further believed that the adhesion of these polymers alters the surface properties of the glass thus allowing water to "sheet" more readily. The polymers of this invention have one or more monomeric units containing at least one N-oxide group. At least about 10%, preferably more than about 50%, more preferably greater than about 90% of said monomers forming said polymers contain an amine oxide group. These polymers can be described by the general formula:

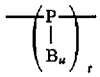

wherein each P is selected from homopolymerizable and copolymerizable moieties which attach to form the polymer backbone, preferably vinyl moieties, e.g. $C(R)_2—C(R)_2$, wherein each R is H, $C_1–C_{12}$ (preferably $C_1–C_4$) alkyl(ene), $C_6–C_{12}$ aryl(ene) and/or B; B is a moiety selected from substituted and unsubstituted, linear and cyclic $C_1–C_{12}$ alkyl, $C_1–C_{12}$ alkylene, $C_1–C_{12}$ heterocyclic, aromatic $C_6–C_{12}$ groups and wherein at least one of said B moieties has at least one amine oxide (≡N→O) group present; u is from a number that will provide at least about 10% monomers containing an amine oxide group to about 2; and t is number such that the average molecular weight of the polymer is from about 2,000 to about 100,000, preferably from about 5,000 to about 20,000, and more preferably from about 8,000 to about 12,000.

The preferred polymers of this invention possess the unexpected property of being substantive without leaving a visible residue that would render the glass surface unappealing to consumers. The preferred polymers include poly(4-vinylpyridine N-oxide) polymers (PVNO), e.g. those formed by polymerization of monomers that include the following moiety:

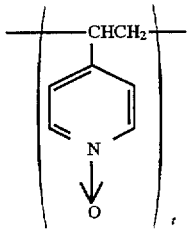

wherein, for the purposes of this invention, t is a number such that the average molecular weight of the polymer is from about 2,000 to about 100,000, preferably from about 5,000 to about 20,000, and more preferably from about 8,000 to about 12,000. The desirable molecular weight range of polymers useful in the present invention stands in contrast to that found in the art relating to polycarboxylate, polystyrene sulfonate, and polyether based additives which prefer molecular weights in the range of 400,000 to 1,500,000.

The level of amine oxide polymer should normally be from about 0.01% to about 1%, preferably from about 0.05% to about 0.5%, more preferably from about 0.1% to about 0.3%, by weight of the composition.

B. HYDROPHOBIC SOLVENT

In order to improve cleaning in liquid compositions, one can use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T \left[ \frac{a-1}{a} \right]^{1/2}$$

wherein γH is the hydrogen bonding parameter, a is the aggregation number, $$(\text{Log } a = 3.39066\ T_b/T_c - 0.15848 - \text{Log } M),$$

and

γT is the solubility parameter which is obtained from the formula:

$$\gamma T = \left[ \frac{(\Delta H_{25} - RT)d}{M} \right]^{1/2}$$

where $\Delta H_{25}$ is the heat of vaporization at 25° C., R is the gas constant (1.987 cal/mole/deg), T is the absolute temperature in °K, $T_b$ is the boiling point in °K, $T_c$ is the critical temperature in °K, d is the density in g/ml, and M is the molecular weight.

For the compositions herein, hydrogen bonding parameters are preferably less than about 7.7, more preferably from about 2 to about 7, or 7.7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Hydrophobic solvents are typically used at a level of from about 0.5% to about 30%, preferably from about 2% to about 15%, more preferably from about 3% to about 8%. Dilute compositions typically have solvents at a level of from about 1% to about 10%, preferably from about 3% to about 6%. Concentrated compositions contain from about 10% to about 30%, preferably from about 10% to about 20% of solvent.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6–C_9$ alkyl aromatic solvents, especially the $C_6–C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, glycol ethers useful herein have the formula $R^{11}O—(R^{12}O—)_m1H$ wherein each $R^{11}$ is an alkyl group which contains from about 3 to about 8 carbon atoms, each $R^{12}$ is either ethylene or propylene, and $m^1$ is a number from 1 to about 3. The most preferred glycol ethers are selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Solvents such as pine oil, orange terpene, benzyl alcohol, n-hexanol, phthalic acid esters of $C_{1-4}$ alcohols, butoxy propanol, Butyl Carbitol® and 1(2-n-butoxy-1-methylethoxy)propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, of the secondary isomer in which the butoxy group is attached to the secondary atom of the propanol for improved odor.

C) THE DETERGENT SURFACTANT (1) The Amphocarboxylate Detergent Surfactant

The aqueous, liquid hard surface detergent compositions (cleaners) herein can contain from about 0.001% to about 2%, preferably from about 0.01% to about 0.5%, more preferably from about 0.02% to about 0.2%, and even more preferably from about 0.03% to about 0.08%, of $C_{6-10}$ short chain amphocarboxylate detergent surfactant. It has been found that these amphocarboxylate, and, especially glycinate, detergent surfactants provide good cleaning with superior filming/streaking for detergent compositions that are used to clean both glass and/or relatively hard-to-remove soils. Despite the short chain, the detergency is good and the short chains provide improved filming/streaking, even as compared to most of the zwitterionic detergent surfactants described hereinafter. Depending upon the level of cleaning desired and/or the amount of hydrophobic material in the composition that needs to be solubilized, one can either use only the amphocarboxylate detergent surfactant, or can combine it with cosurfactant, preferably said zwitterionic surfactants.

The "amphocarboxylate" detergent surfactants herein preferably have the generic formula:

$$RN(R^1)(CH_2)_nN(R^2)(CH_2)_pC(O)OM$$

wherein R is a $C_{6-10}$ hydrophobic moiety, typically a fatty acyl moiety containing from about 6 to about 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl, each n is an integer from 1 to 3, each p is an integer from 1 to 2, preferably 1, and each M is a water-soluble cation, typically an alkali metal, ammonium, and/or alkanolammonium cation. Such detergent surfactants are available, for example: from Witco under the trade name Rewoteric AM-V®, having the formula $$C_7H_{15}C(O)NH(CH_2)_2N(CH_2CH_2OH)CH_2C(O)O^{(-)}Na^{(+)};$$

Mona Industries, under the trade name Monateric 1000®, having the formula $$C_7H_{15}C(O)NH(CH_2)_2N(CH_2CH_2OH)CH_2CH_2C(O)O^{(-)}Na^{(+)};$$

and Lonza under the trade name Amphoterge KJ-2®, having the formula $$C_{7,9}H_{15,19}C(O)NH(CH_2)_2N(CH_2CH_2OCH_2C(O)O^{(-)}Na^{(+)})CH_2C(O)O^{(-)}Na^{(+)}.$$

(2) Zwitterionic Detergent Surfactant

The aqueous, liquid hard surface detergent compositions (cleaners) herein can contain from about 0.001% to about 2% of suitable zwitterionic detergent surfactant containing a cationic group, preferably a quaternary ammonium group, and an anionic group, preferably carboxylate, sulfate and/or sulfonate group, more preferably sulfonate. A more preferred range of zwitterionic detergent surfactant inclusion is from about 0.02% to about 1% of surfactant, a most preferred range is from about 0.05% to about 0.2%.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic detergent surfactants have the generic formula:

$$R^3—[C(O)—N(R^4)—(CR^5)_{n1}]_mN(R^6)_2^{(+)}—(CR^5_2)_p1–Y^{(-)}$$

wherein each Y is preferably a carboxylate ($COO^-$) or sulfonate ($SO_3^-$) group, more preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups with no more than one hydroxy group in any $(CR^5_2)_p^1$ group; wherein ($R^6$) is like $R^4$ except preferably not hydrogen; wherein m is 0 or 1; and wherein each $n^1$ and $p^1$ are an integer from 1 to about 4, preferably from 2 to about 3, more preferably about 3. The $R^3$ groups can be branched, unsaturated, or both and such structures can provide filming/streaking benefits, even when used as part of a mixture with straight chain alkyl $R^3$ groups. The $R^4$ groups can also be connected to form ring structures such as imidazoline, pyridine, etc. Preferred hydrocarbyl amidoalkylene sulfobetaine (HASB) detergent surfactants wherein m=1 and Y is a sulfonate group provide superior grease soil removal and/or filming/streaking and/or "anti-fogging" and/or perfume solubilization properties. Such hydrocarbylamidoalkylene sulfobetaines, and, to a lesser extent hydrocarbylamidoalkylene betaines are excellent for use in hard surface cleaning detergent compositions, especially those formulated for use on both glass and hard-to-remove soils. They are even better when used with monoethanolamine and/or specific beta-amino alkanol as disclosed herein.

A more preferred specific detergent surfactant is a $C_{10-14}$ fatty acylamidopropylene(hydroxypropylene)sulfobetaine, e.g., the detergent surfactant available from the Witco Company as a 40% active product under the trade name "REWOTERIC AM GAS Sulfobetaine®."

The level of zwitterionic detergent surfactant, e.g., HASB, in the composition is typically from about 0.001% to about 2.0%, preferably from about 0.02% to about 1.0%. The level in the composition is dependent on the eventual level of dilution to make the wash solution. It is an advantage of the zwitterionic detergent, e.g., HASB, that compositions containing it can be more readily diluted by consumers since it does not interact with hardness cations as readily as conventional anionic detergent surfactants. Zwitterionic detergents are also extremely effective at very low levels, e.g., below about 1%.

Other zwitterionic detergent surfactants are set forth at Col. 4 of U.S. Pat. No. 4,287,080, Siklosi, incorporated herein by reference. Another detailed listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

(3) Anionic and Optional Nonionic Detergent Surfactant

The detergent compositions, preferably aqueous, liquid hard surface detergent compositions, herein can contain, as the cosurfactant, less preferred, or as the primary detergent surfactant, preferably, from about 0.001% to about 2.0%, preferably from about 0.01% to about 1.0% of suitable anionic detergent surfactant. The anionic surfactants are suitably water-soluble alkyl or alkylaryl compounds, the alkyl having from about 6 to about 20 carbons, and including a sulfate or sulfonate substituent group. Depending upon the level of cleaning desired one can use only the anionic detergent surfactant, or the anionic detergent surfactant can be combined with a cosurfactant, preferably an amphoteric cosurfactant.

The anionic detergent surfactants herein preferably have the generic formula:

$$R^9—(R^{10})_{0-1}SO_3^{(-)}M^{(+)}$$

wherein $R^9$ is a $C_6$–$C_{20}$ alkyl chain, preferably a $C_8$–$C_{16}$ alkyl chain; $R^{10}$, when present, is a $C_6$–$C_{20}$ alkylene chain, preferably a $C_8$–$C_{16}$ alkylene chain, a $C_6H_4$ phenylene group, or O; and M is the same as before.

The most preferred compositions herein preferably contain from about 0.001% to about 2%, by weight of the composition, more preferably from about 0.01% to about 1%, most preferably from about 0.02% to about 0.3%, by weight of the composition, of one or more chainlengths of a linear alcohol sulfate detergent surfactant having the general formula:

$$R—O—SO_3M$$

wherein M is any suitable counterion, preferably sodium, potassium, etc.; and wherein R is an alkyl group with a chainlength of from about $C_8$ to about $C_{18}$ and mixtures thereof, preferably from about $C_{12}$ to about $C_{18}$ and mixtures thereof, more preferably from about $C_{14}$ to about $C_{18}$ and mixtures thereof, and wherein R is $C_{14}$ in more than about 30%, preferably more than about 35%, more preferably more than about 40%, by weight of the alkyl sulfate. The entire alkyl sulfate surfactant can contain R of $C_{14}$ and longer chainlength(s), but more than 30%, by weight of the alkyl surfactant preferably must be a $C_{14}$ chainlength. Compositions containing only alkyl sulfate surfactants with higher chainlengths, i.e., $C_{16-18}$ provide good surface lubricity benefits. However, these chain lengths, without the required amount of $C_{14}$ chainlengths, exhibit poor filming/streaking properties. On the other hand, compositions which are solely made up of lower-chain alkyl sulfate surfactants, i.e., $C_{8-12}$ alkyl sulfate surfactants, provide acceptable filming/streaking properties but show poor surface lubricity properties. The presence of the $C_{14}$ chainlength at levels of more than about 30%, by weight of the alkyl sulfate surfactant, in combination with other chainlengths, or alone, provide a product with both excellent surface lubricity properties and excellent filming/streaking properties. Particularly preferred compositions contain from about 0.05% to about 0.30%, by weight of the composition, of a $C_{12/14}$ blend in which the $C_{12}$ to $C_{14}$ weight ratio is from about 1:10 to about 2:1, preferably from about 1:5 to about 1.5:1, and more preferably from about 1:3 to about 1:1. This combination has been found to provide sufficient surface lubricity while avoiding objectionable filming/streaking. The alcohol sulfate detergent raw materials selected are essentially free from unreacted fatty alcohol wherein the term "essentially free" is defined as having less than about 2%, by weight of the composition, preferably less than about 1.8%, and more preferably less than about 1.5%, by weight of the composition of unreacted fatty alcohol in a nominally 30% active raw material.

A most preferred alkyl sulfate surfactant is a mixture of Stepanol WA-Extra®, available from the Stepan Company, with extra $C_{14}$ alkyl sulfate added such that the $C_{12/14}$ ratio is nearly 1:1.

Concentrated compositions can also be used in order to provide a less expensive product. When a higher concentration is used, i.e., when the level of alkyl sulfate surfactant used is from about 0.10% to about 2.0%, by weight of the composition, it is preferable to dilute the composition before using it to clean a hard surface, especially glass. Dilution ratios of the alkyl sulfate concentrate(s) to water can range, preferably, from about 1:1 to 1:10, more preferably from about 1:1.5 to 1:5, and most preferably from about 1:2 to 1:5.

Some suitable surfactants for use herein in small amounts are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol® 15-S-3, Tergitol® 15-S-5, Tergitol® 15-S-7, and Tergitol® 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

$$R^7—\overset{\overset{\displaystyle O}{\|}}{C}—N(R^8)_2$$

wherein $R^7$ is a straight-chain alkyl group containing from about 7 to about 15 carbon atoms and having an average carbon chain length of from about 9 to about 13 carbon atoms and wherein each $R^8$ is a hydroxy alkyl group containing from 1 to about 3 carbon atoms; a zwitterionic surfactant having one of the preferred formulas set forth hereinafter; or a phosphine oxide surfactant. Another suitable class of surfactants is the fluorocarbon surfactants, examples of which are FC-129®, a potassium fluorinated alkylcarboxylate and FC-170-C®, a mixture of fluorinated alkyl polyoxyethylene ethanols, both available from 3M Corporation, as well as the Zonyl® fluorosurfactants, available from DuPont Corporation. It is understood that mixtures of various surfactants can be used.

Nonionic surfactants, e.g., ethoxylated alcohols and/or alkyl phenols, can also be used as cosurfactants.

(4) Mixtures

Mixtures of amphocarboxylate, zwitterionic detergent surfactants, and/or anionic detergent surfactants as discussed hereinbefore, can be present in the present invention. The zwitterionic detergent surfactants can be present at levels from about 0.02% to about 15%. The amphocarboxylate detergent surfactants can be present at levels from about 0.001% to about 15%. The ratio of zwitterionic detergent surfactant to amphocarboxylate detergent surfactant is typically from about 3:1 to about 1:3, preferably from about 2:1 to about 1:2, more preferably about 1:1. The ratio of primary detergent surfactant to cosurfactant, or cosurfactants, is typically from about 3:1 to about 1: 1.

(D) AQUEOUS SOLVENT SYSTEM

The balance of the formula is typically water and non-aqueous polar solvents with only minimal cleaning action like methanol, ethanol, isopropanol, ethylene glycol, glycol ethers having a hydrogen bonding parameter of greater than 7.7, propylene glycol, and mixtures thereof, preferably ethanol. The level of non-aqueous polar solvent is usually greater when more concentrated formulas are prepared. Typically, the level of non-aqueous polar solvent is from about 0.5% to about 40%, preferably from about 1% to about 10%, more preferably from about 2% to about 8% (especially for "dilute" compositions) and the level of water is from about 50% to about 99%, preferably from about 75% to about 95%.

(E) OPTIONAL INGREDIENTS (1) Optional soluble carbonate and/or bicarbonate salts Water-soluble alkali metal carbonate and/or bicarbonate salts, such as sodium bicarbonate, potassium bicarbonate, potassium carbonate, cesium carbonate, sodium carbonate, and mixtures thereof, are added to the composition of the present invention in order to improve the filming/streaking when the product is wiped dry on the surface, as is typically done in glass cleaning. Preferred salts are sodium carbonate, potassium carbonate, sodium bicarbonate, potassium bicarbonate, their respective hydrates, and mixtures thereof. Solubilized, water-soluble alkali metal carbonate and bicarbonate salts are typically present at a level of from about 0% to about 0.5%, preferably from about 0.005% to about 0.1%, more preferably from about 0.01% to about 0.1%, and most preferably from about 0.02% to about 0.05% by weight of the composition. The pH in the composition, at least initially, in use is from about 7 to about 11, preferably from about 7.5 to about 10.5, more preferably from about 8 to about 10. pH is typically measured on the product.

(2) Optional tartaric acid/monoethanolamine salt

Detergent builders that are efficient for hard surface cleaners and have reduced filming/streaking characteristics at the critical levels can also be employed in the present invention. Addition of the specific detergent builder tartaric acid at critical levels to the present composition improves cleaning without the problem of filming/streaking that usually occurs when detergent builders are added to hard surface cleaners. Through the present invention there is no longer the need to make a compromise between improved cleaning and acceptable filming/streaking results which is especially important for hard surface cleaners which are also directed at cleaning glass. These compositions containing the detergent builder herein at the levels herein, have exceptionally good cleaning properties. They also have exceptionally good shine properties, i.e., when used to clean glossy surfaces, without rinsing, they have much less tendency than, e.g., carbonate built products to leave a dull finish on the surface and filming/streaking.

The tartaric acid detergent builder is present at levels of from about 0.001% to about 0.1%, more preferably from about 0.01% to about 0.1%, and most preferably from about 0.01% to about 0.05%. The salts are preferably compatible and include ammonium, sodium, potassium and/or alkanolammonium salts. The alkanolammonium salt is preferred. The preferred alkanolammonium salt is that formed by the addition of monoethanolamine (MEA) at a level of from about 0.005% to about 0.2%, preferably from about 0.01% to about 0.1%, more preferably from about 0.02% to about 0.1% by weight of the composition.

(F) OPTIONAL MINOR INGREDIENTS

The compositions herein can also contain other various adjuncts which are known to the art for detergent compositions. Preferably they are not used at levels that cause unacceptable filming/streaking. Non-limiting examples of such adjuncts are:

Hydrotropes such as sodium toluene sulfonate, sodium cumene sulfonate and potassium xylene sulfonate; and Aesthetic-enhancing ingredients such as colorants and perfumes, providing they do not adversely impact on filming/streaking in the cleaning of glass. Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. The perfumes are preferably those that are more water-soluble and/or volatile to minimize streaking and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Antibacterial agents can be present, but preferably only at low levels to avoid filming/streaking problems. More hydrophobic antibacterial/germicidal agents, like orthobenzyl-para-chlorophenol, are avoided. If present, such materials should be kept at levels below about 0.1%.

Stabilizing ingredients can be present typically to stabilize more of the hydrophobic ingredients, e.g., perfume. The stabilizing ingredients include acetic acid and propionic acids, and their salts, e.g., $NH_4$, MEA, Na, K, etc., preferably acetic acid and the $C_2$–$C_6$ alkane diols, more preferably butane diol. The stabilizing ingredients do not function in accordance with any known principle. Nonetheless, the combination of amido zwitterionic detergent surfactant with linear acyl amphocarboxylate detergent surfactant, anionic detergent surfactant, nonionic detergent surfactant, or mixtures thereof, and stabilizing ingredient can create a microemulsion. The amount of stabilizing ingredient is typically from about 0.01% to about 0.5%, preferably from about 0.02% to about 0.2%. The ratio of hydrophobic material, e.g., perfume that can be stabilized in the product is related to the total surfactant and typically is in an amount that provides a ratio of surfactant to hydrophobic material of from about 1:2 to about 2:1.

Other detergent builders that are efficient for hard surface cleaners and have reduced filming/streaking characteristics at the critical levels can also be present in the compositions of the invention.

Suitable additional optional detergent builders include salts of ethylenediaminetetraacetic acid (hereinafter EDTA), citric acid, nitrilotriacetic acid (hereinafter NTA), sodium carboxymethylsuccinic acid, sodium N-(2-hydroxypropyl)-iminodiacetic acid, and N-diethyleneglycol-N,N-diacetic acid (hereinafter DIDA). The salts are preferably compatible and include ammonium, sodium, potassium and/or alkanolammonium salts. The alkanolammonium salt is preferred as described hereinafter. A preferred detergent builder is NTA (e.g., sodium), a more preferred builder is citrate (e.g., sodium or monoethanolamine), and a most preferred builder is EDTA (e.g., sodium).

These additional optional detergent builders, when present, are typically at levels of from about 0.05% to about 0.5%, more preferably from about 0.05% to about 0.3%, most preferably from about 0.05% to about 0.15%. The levels of these additional builders present in the wash solution used for glass should be less than about 0.2%. Therefore, typically, dilution is highly preferred for cleaning glass, while full strength is preferred for general-purpose cleaning, depending on the concentration of the product.

Typically the best filming/streaking results occurs most when the builder is combined with amphoteric and/or zwitterionic detergent surfactant compositions although an improvement is also seen with the less preferred anionic or anionic/nonionic detergent surfactant compositions.

The invention is illustrated by the following nonlimiting Examples.

End Result Wipe Test

Procedure:

Five sprays of the product to be tested are applied to a 2 ft.×3 ft. glass window (which can be soiled with body oils from a handprint) and wiped with two paper towels to near dryness, simulating actual consumer usage of the product.

Grading:

Expert judges are employed to evaluate the specific areas of product application for amount of filming/streaking, with the aid of a floodlight to simulate a sunbeam. A numerical value describing the quality of the end result is assigned to each product. For the test results reported here a 0–6 scale is used, in which 0=good end result with no film/streak, and 6=very poor end result.

EXAMPLE I

| | Formula | |
|---|---|---|
| INGREDIENT | 1 Wt. % | 2 Wt. % |
| Butoxypropanol | 2.8 | 2.8 |
| Ethanol | 2.8 | 2.8 |
| Sodium Dodecyl Sulfate | 0.13 | 0.20 |
| Sodium Tetradecyl Sulfate | 0.11 | 0.08 |
| $NaHCO_3$ | 0.02 | 0 |
| $NaCO_3$ | 0.02 | 0 |
| PVNO (avg MW ~ 10,000) | 0.20 | 0 |

The above formulas were tested according to the above methods for end result wipe, with the results as follows (average of 7 different wiping habits):

| Wiping Film/Streak Test (avg. of 7 different wiping habits) | |
|---|---|
| Formula | Rating |
| | (0 = good, 6 = poor) |
| 1 | 1.15 |
| 2 | 1.39 |

These results show that the inclusion of the polymer does not harm film/streak. In fact, it is directionally better than the comparison formula.

Sheeting Test

The following test is used to determine the lasting effects of preventing water spots upon rewetting.

The windows, or mirrors, film the Filming/Streaking Test are rewetted by spraying with water containing about 0.02% household dust to simulate rain and dried, and this cycle is repeated twice more for a total of three cycles. The windows, or mirrors, are graded while wet using a scale in which 0=No Sheeting and 6=Heavy Sheeting. The sheeting is indicative of the hydrophilicity and the resulting lack of spotting/filming when dry.

| | Average Sheeting Grade | | |
|---|---|---|---|
| Formula No. | cycle 1 | cycle 2 | cycle 3 |
| 1 | 6.0 | 6.0 | 5.3 |
| 2 | 3.7 | 0.5 | 0.0 |
| Blank Glass | 0.5 | 0.0 | 0.0 |

The above demonstrates the benefit of the polymer, when used at this level, in providing the sheeting (anti-spotting/filming) benefit upon rewetting.

The formulas are tested as in the above test for sheeting, but the samples are dried and graded for "rainspots" using the grading scale of the Filming/Streaking Test.

| | Average "Rainspot" Grade (0 = good, 6 = poor) | | |
|---|---|---|---|
| Formula No. | cycle 1 | cycle 2 | cycle 3 |
| 1 | 0.0 | 0.0 | 0.1 |
| 2 | 1.0 | 3.1 | 4.2 |
| Blank Glass | 2.8 | 4.1 | 5.2 |

These results show the benefit of the polymer in helping prevent spots on windows even after 3 simulated rainstorms.

| | Formula | | | | |
|---|---|---|---|---|---|
| Component | 3 | 4 | 5 | 6 | 7 |
| Isopropanol | 2.00 | 4.00 | | | 2.00 |
| Ethanol | | | 2.00 | 5.00 | |
| Butoxypropanol | 3.00 | 1.50 | 2.50 | 1.00 | 4.00 |
| $C_{12}$ Alkyl Sulfate | 0.20 | | | | |
| $C_{14}$ Alkyl Sulfate | 0.08 | | | | 0.10 |
| Cocoamidopropylbetaine | | 0.20 | | | 0.10 |
| Linear Alkyl ($C_8$–$C_{18}$) Benzen Sulfonate | | | 0.10 | | |
| Sodium Laureth Sulfate | | | | 0.25 | |

-continued

| Component | Formula 3 | 4 | 5 | 6 | 7 |
|---|---|---|---|---|---|
| Alcohol Ethoxylate (Neodol ® 91-6) | | | 0.04 | | |
| Sodium Bicarbonate | | 0.02 | | 0.06 | 0.04 |
| Monoethanolamine | | | 0.1 | | |
| Tartaric Acid | | | 0.03 | | |
| PVNO (avg MW ~ 10,000) | 0.10 | 0.15 | 0.25 | 0.30 | 0.20 |

What is claimed is:

1. Detergent composition that can clean glass without leaving objectionable levels of spots and/or films consisting essentially of:

(A) from about 0.05% to about 0.5%, by weight of the composition, of PVNO having an average molecular weight of from about 2,000 to about 100,000;

(B) from about 0.5% to about 30%, by weight of the composition, of hydrophobic solvent, having a hydrogen bonding parameter of from about 2 to about 7.7;

(C) from about 0.01% to about 0.3%, by weight of the composition, of a linear alkyl sulfate detergent surfactant having the general formula:

$$R^{11}O—SO_3M$$

wherein M is a suitable counter ion; $R^{11}$ is an alkyl group having a chain length of from about $C_8$ to about $C_{18}$ or mixtures thereof; wherein more than about 40%, by weight of said surfactant, of said surfactant has a $C_{14}$ chainlength; and (D) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof and any minor ingredients.

2. The composition of claim 1 wherein the PVNO has an average molecular weight of from about 8,000 to about 12,000.

3. The composition of claim 2 further comprising from about 0.02% to about 0.05% of $NaHCO_3$ and from about 0.02% to about 0.05% $Na_2CO_3$.

4. The composition of claim 3 further comprising from about 0.02% to about 0.05% of monoethanolamine (MEA) and from about 0.01% to about 0.05% tartaric acid.

5. The composition of claim 3 wherein the level of PVNO is from about 0.1% to about 0.3% by weight of the composition.

6. The process of cleaning glass, that is subject to rewetting, with an effective amount of the composition of claim 4 to provide anti-spotting/filming effects for at least three rewetting cycles.

* * * * *